US010757999B2

(12) United States Patent
Viniero et al.

(10) Patent No.: US 10,757,999 B2
(45) Date of Patent: Sep. 1, 2020

(54) SKI BOOT PROVIDED WITH AN IMPROVED SKI-WALK SELECTION MECHANISM

(71) Applicant: OBER ALP S.p.A., Bolzano (IT)

(72) Inventors: Nicola Viniero, Bolzano (IT); Eric Hjorleifson, Bolzano (IT)

(73) Assignee: OBER ALP S.P.A. (IT)

( * ) Notice: Subject to any disclaimer, the term of this patent is extended or adjusted under 35 U.S.C. 154(b) by 501 days.

(21) Appl. No.: 15/147,722

(22) Filed: May 5, 2016

(65) Prior Publication Data

US 2016/0324252 A1 Nov. 10, 2016

(30) Foreign Application Priority Data

May 6, 2015 (IT) ..... 102015902348197

(51) Int. Cl.
*A43B 5/04* (2006.01)

(52) U.S. Cl.
CPC ..... *A43B 5/0474* (2013.01); *A43B 5/0496* (2013.01)

(58) Field of Classification Search
CPC ..... A43B 5/0474; A43B 5/0496
(Continued)

(56) References Cited

U.S. PATENT DOCUMENTS 3,665,619 A * 5/1972 Gray ..... A43B 5/0415 36/117.1
4,203,235 A * 5/1980 Van Pelt, Jr. ..... A43B 5/0415 36/118.8

(Continued)

FOREIGN PATENT DOCUMENTS

DE 8020898 U1 11/1980
FR 2764172 A1 12/1998

OTHER PUBLICATIONS

Italian Search Report dated Jan. 15, 2016.

*Primary Examiner* — Katharine Gracz
(74) *Attorney, Agent, or Firm* — Waller Lansden Dortch & Davis LLP; Matthew C. Cox

(57) ABSTRACT

A ski boot comprising a lower part or shell, suitable for enclosing the user's foot and an upper part or cuff, suitable for enclosing the lower part of the skier's leg, wherein the cuff is hinged to the shell so as to rotate relative to the shell around hinges defining a rotation axis, forward, toward a tip of the boot, and backwards toward a heel of the boot, wherein the boot comprises fastening means suitable for selectively locking and/or unlocking the rotation of the cuff with respect to the shell depending on whether the user wants to switch from a skiing configuration to a walking configuration, respectively. Advantageously the fastening means comprise a slider interposed between the cuff and the shell, wherein said slider is fixed in rotation to the cuff and it comprises first and second end stops, placed at opposite sides of the slider, wherein the slider is movable in translation with respect to the cuff in order to move from the unlock or walking configuration, wherein the first and second end stops do not interfere with the rotation of the cuff with respect to the shell, to the lock or ski configuration wherein the first and second end stops abut against respective first and second abutment of the shell, wherein first abutment blocks the forward rotation of the cuff with respect to the shell and second abutment blocks the backward rotation of the cuff with respect to the shell.

9 Claims, 6 Drawing Sheets

(58) Field of Classification Search
USPC ..... 36/118.2, 118.9, 117.4
See application file for complete search history.

(56) References Cited

U.S. PATENT DOCUMENTS 4,519,150 A * 5/1985 Arieh ..... A43B 5/0452 24/71 SK
4,575,957 A * 3/1986 Petrini ..... A43B 5/048 36/105
4,761,899 A * 8/1988 Marxer ..... A43B 5/0433 36/105
4,835,886 A * 6/1989 Chemello ..... A43B 5/0405 36/117.8
4,839,973 A * 6/1989 Dodge ..... A43B 5/0452 36/118.7
4,897,940 A * 2/1990 Sartor ..... A43B 5/0439 36/117.8
4,934,075 A 6/1990 Benetti et al.
5,031,341 A * 7/1991 Paris ..... A43B 5/0452 36/118.2
5,046,268 A * 9/1991 Munari ..... A43B 5/0433 36/117.8
5,065,533 A * 11/1991 Paris ..... A43B 5/0474 36/118.1
5,107,609 A * 4/1992 Sartor ..... A43B 5/0478 36/118.8
5,341,584 A 8/1994 Paris et al.
5,381,613 A * 1/1995 Pozzobon ..... A43B 5/04 36/117.1
5,394,628 A 3/1995 DeMarchi
5,485,688 A * 1/1996 Gorza ..... A43B 5/048 24/71 SK
5,553,402 A * 9/1996 Marega ..... A43B 5/0409 36/117.7
5,560,128 A * 10/1996 Marega ..... A43B 5/0474 36/118.2
5,678,331 A * 10/1997 Bonaventure ..... A43B 5/0433 36/117.1
5,819,441 A * 10/1998 Perrissoud ..... A43B 5/0456 36/118.2
5,857,271 A 1/1999 Pallatin
5,979,082 A * 11/1999 Pallatin ..... A43B 5/04 36/118.2
6,101,745 A * 8/2000 Grandin ..... A43C 11/1413 36/118.2
6,131,313 A * 10/2000 Pierce ..... A43B 5/0474 36/118.3
2005/0016027 A1 1/2005 Trinkaus et al.
2005/0126048 A1* 6/2005 Leitner ..... A43B 3/0084 36/138
2008/0141561 A1* 6/2008 Battilana ..... A43B 5/0472 36/50.5
2008/0172907 A1* 7/2008 Sartor ..... A43B 5/0474 36/118.4
2009/0178304 A1* 7/2009 Bollard ..... A43B 5/0474 36/118.2
2012/0198725 A1* 8/2012 Sartor ..... A43B 5/0474 36/132
2012/0246975 A1* 10/2012 Wieser ..... A43B 5/0431 36/109
2013/0074373 A1* 3/2013 Venturato ..... A43B 5/0431 36/117.1
2013/0097892 A1* 4/2013 Viniero ..... A43B 5/047 36/117.1
2013/0180133 A1* 7/2013 Delladio ..... A43B 5/0427 36/118.7

* cited by examiner

SKI BOOT PROVIDED WITH AN IMPROVED SKI-WALK SELECTION MECHANISM

FIELD OF THE INVENTION

The present invention relates to a ski boot provided with an improved ski-walk selection mechanism.

STATE OF THE ART

The mountaineering or Alpine ski boots must allow the skier to pass from skiing to walking configuration alternatively, in an easy and comfortable way.

In order to pass form skiing to walking configuration, known ski mountaineering or Alpine boots comprise an upper part or cuff of the boot, suitable for enclosing the lower part of the skier's leg, which is hinged to a lower part of shell of the boot, which is suitable for enclosing the user's foot.

In particular, the rotation of the cuff with respect to the shell grants a better and more comfortable walking, since it follows the natural rotation of the ankle.

Such rotation of the cuff can be blocked by fixing the cuff to the shell, reversibly, in order to grant a correct and precise skiing.

The passage form the walking to the skiing configuration should be as much rapid and easy as possible since the skier, during ski mountaineering, has to pass from the two configurations a lot of times, according to the passage/path to afford.

PRESENTATION OF THE INVENTION

The main solutions of the prior art provide that the cuff is hinged to the shell and that its rotation movement is guided by at least one rod.

The rod in correspondence of a first fixed end is hinged in turn to the shell, while at a second free end, it slides inside a guide fixed to the cuff.

In the walking configuration, the free end of the rod can slide within the guide fixed to the cuff; moreover in the walking configuration the rod can rotate around the first end so as to follow the rotation of the cuff. In the skiing configuration, the free end of the rod is fixed to the guide and then to the cuff.

The closure or blocking of the rod may be realised by means of a pin which enters a hole positioned on the rod.

Prior art solutions have a lot of drawbacks.

In fact, in the skiing configuration there is always a certain resistance to the rotation of the cuff due to the fact that the free end of the locking rod rubs against its seat/portion of the cuff adapted to lodge it/drive it.

In other words, the rod tends to get stuck inside the guide thus making the walk particularly tiring. The problem is further amplified due to the low operating temperature and snow/ice that, during use, further tends to fit between the rod and the related guidance making it increasingly difficult relative displacement between them.

Also, the type of driving of the cuff adopted by the known solutions imposes severe limitations on placements between the hinges of reciprocal connection of the cuff to the cuff and the anchorages of the guide rod. These geometric limits are used to limit only partially the problem of the sticking of the cuff but, on the other hand, create strong constraints to the overall aesthetics and functionality of the boot.

Moreover, also in the skiing position, the known solutions do never guarantee an adequate stiffness, for example comparable to that obtainable by an equivalent ski boot, in particular with the cuff of the fixed type or non-rotatable with respect to the cuff.

In fact, the shape coupling between the pin/peg and the respective seat is inevitably free type and thus implies the presence of a clearance, albeit limited.

Moreover, if there were no clearance, the locking operation by the user becomes anything but convenient, since the pin would be from time to time stuck in its seat. The clearance, even if limited in coupling shaft/bore, results in a movement forwards and backwards of the shank with respect to the hull in the locking configuration, i.e. of skiing. Besides, this clearance also results in an annoying clicking sound every time, shifting weight forward or backward while skiing and/or changes of direction, there is a corresponding shift of the cuff.

This clearance reduces the stiffness of the boot and it certainly reduces the precision of skiing in that the user feels such 'clearance' or 'play' certainly not present in ski boots without the movement of the cuff (e.g. Alpine ski boots).

In summary, the solutions of ski boots of the prior art have excessive resistance to the movement of rotation of the cuff during walking, and excessive clearance of the same cuff during skiing.

In yet other words, the walk is never easy because restrained, and the ski is never as precise as that obtained with a corresponding ski boot, due to the movement of the cuff with respect to the shell even in the closed configuration/locking.

It should be observed that the two requirements, namely the ease of walking and precision of skiing, are often antithetical to the practicality of use: in fact rigid and precise mechanisms of closure, if on the one hand stiffen the structure of the boot, on the other are not very easy to operate by the user.

The convenience of operating is never to be neglected since during an excursion in touring the user must be able to lock/unlock mechanism of ski-walk even dozens of times an hour, without ever having to take off the gloves and often without even stop altogether.

The solution/purpose of the present invention is to provide a ski mountaineering boot that solves the drawbacks mentioned with reference to the known art.

These drawbacks and limitations are solved by a ski boot in accordance with claim 1.

Other embodiments of the boot according to the invention are described in the subsequent claims.

DESCRIPTION OF DRAWINGS

Further characteristics and advantages of the present invention will be better understood from the following description of its preferred and non-limiting embodiment, in which.

The elements or parts of elements in common between the embodiments described below will be indicated with the same reference numerals.

DETAILED DESCRIPTION

Figure 1:
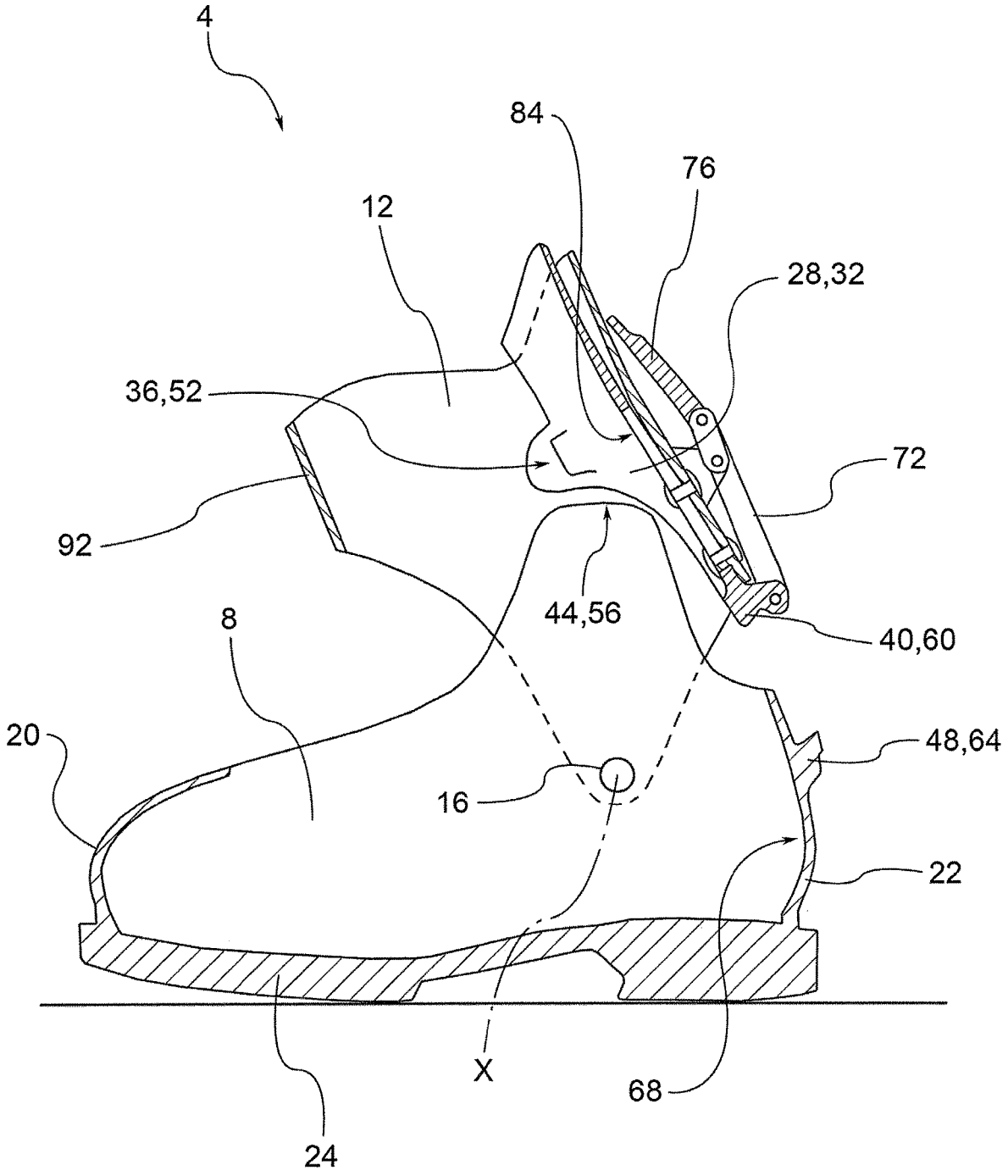
FIG. 1 shows a lateral section view of a ski boot according to an embodiment of the present invention, in a walking configuration, wherein the cuff is in the forward rotation position.
Figure 2:
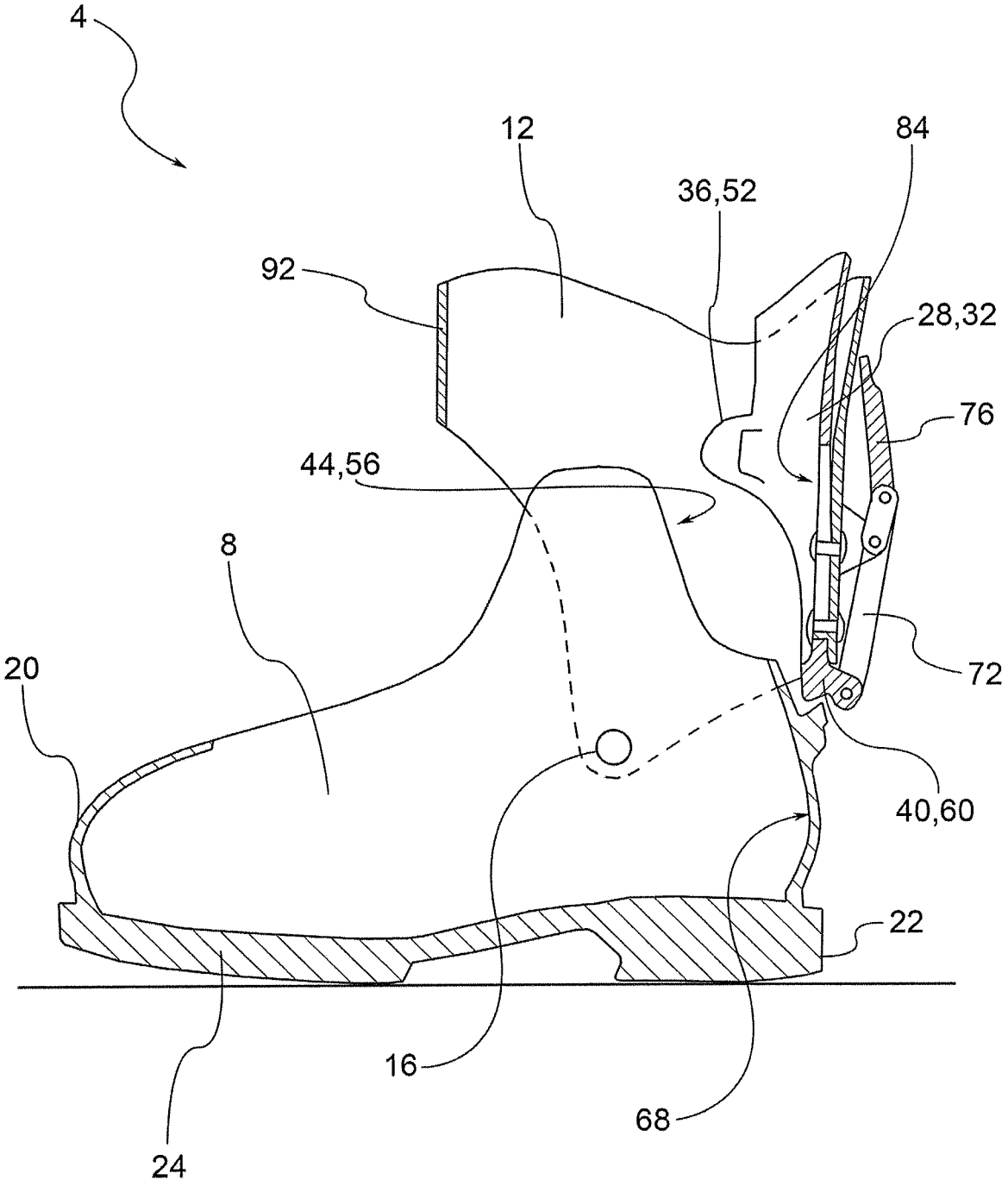
FIG. 2 shows a lateral section view of the ski boot of FIG. 1, in a walking configuration, wherein the cuff is in the rearward rotation position.
Figure 3:
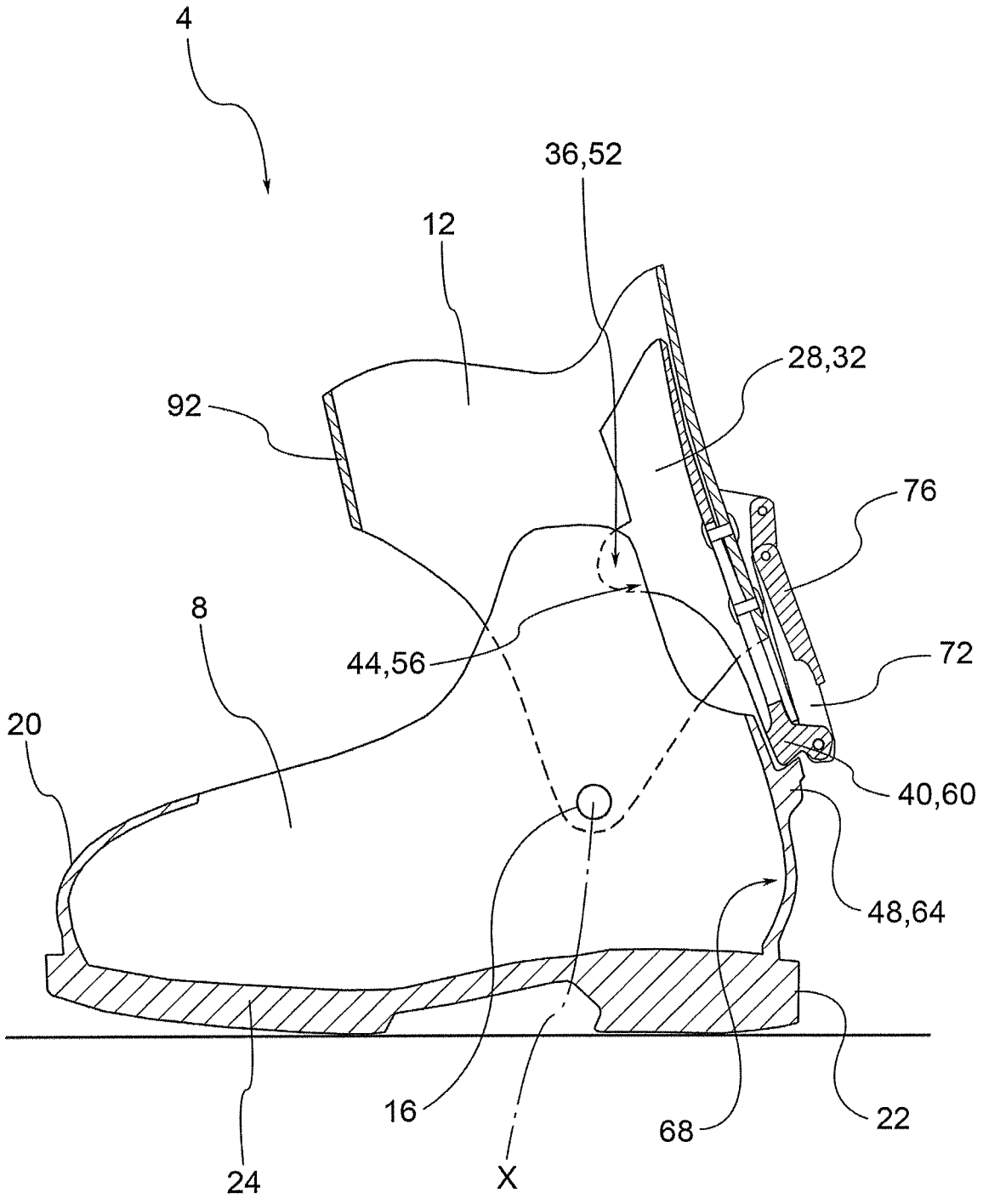
FIG. 3 shows a lateral section view of the ski boot of FIG. 1, in a ski configuration, wherein the cuff is blocked in rotation.
Figure 4:
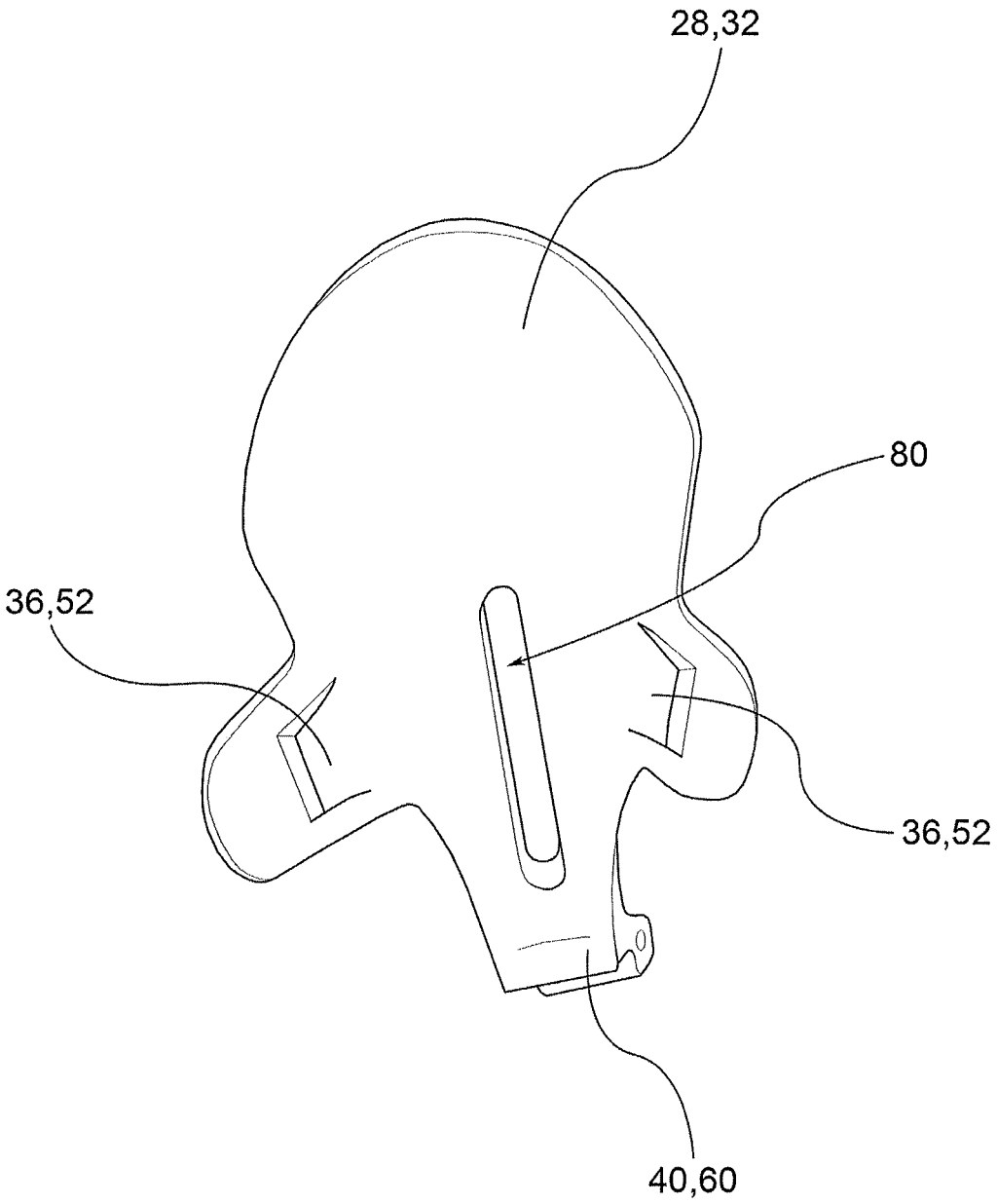
FIG. 4 shows a perspective view of a component of the ski boot of FIG. 1.
Figure 5:
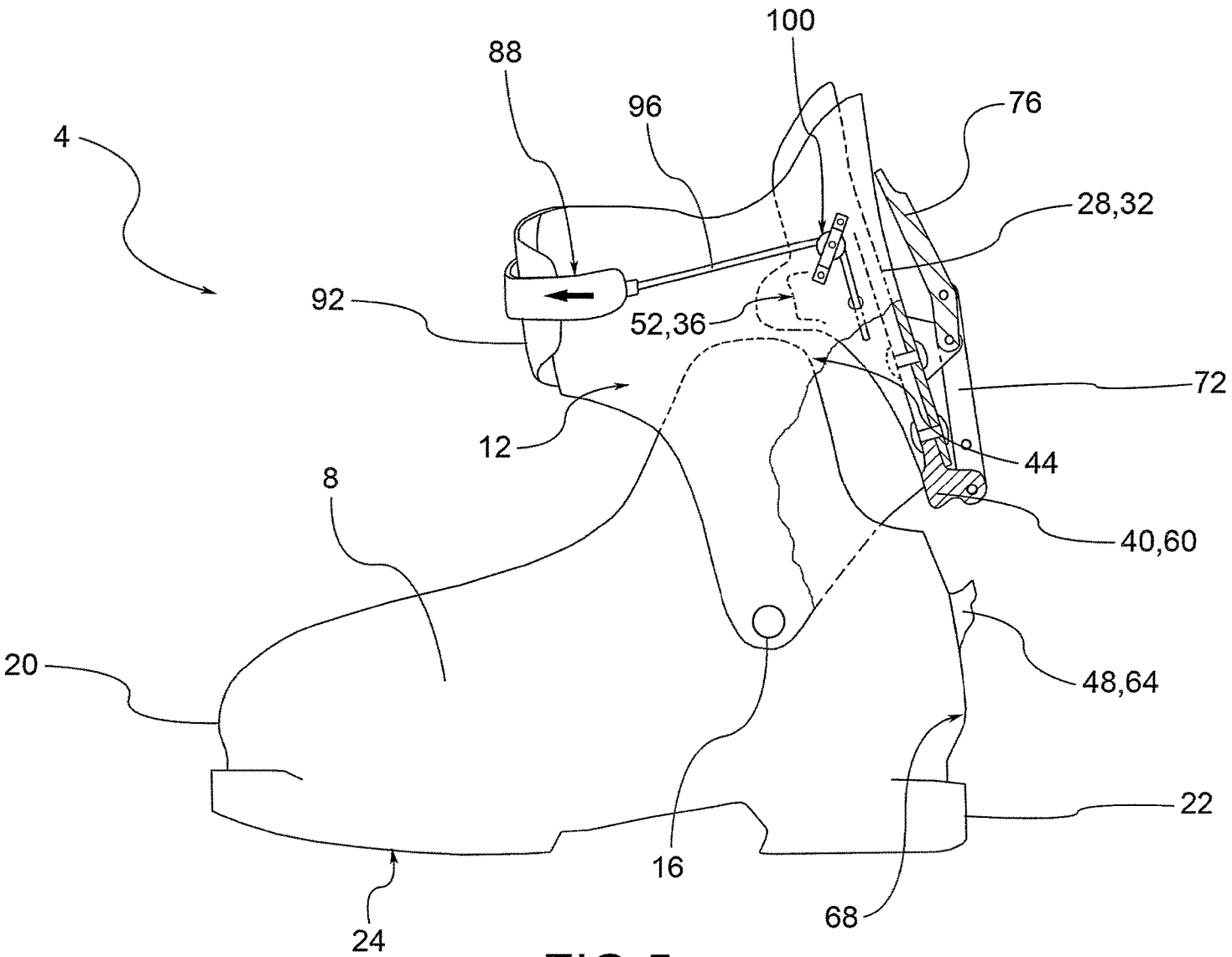
FIG. 5 shows a lateral section view of a ski boot according to another embodiment of the present invention, in a walking configuration.
Figure 6:
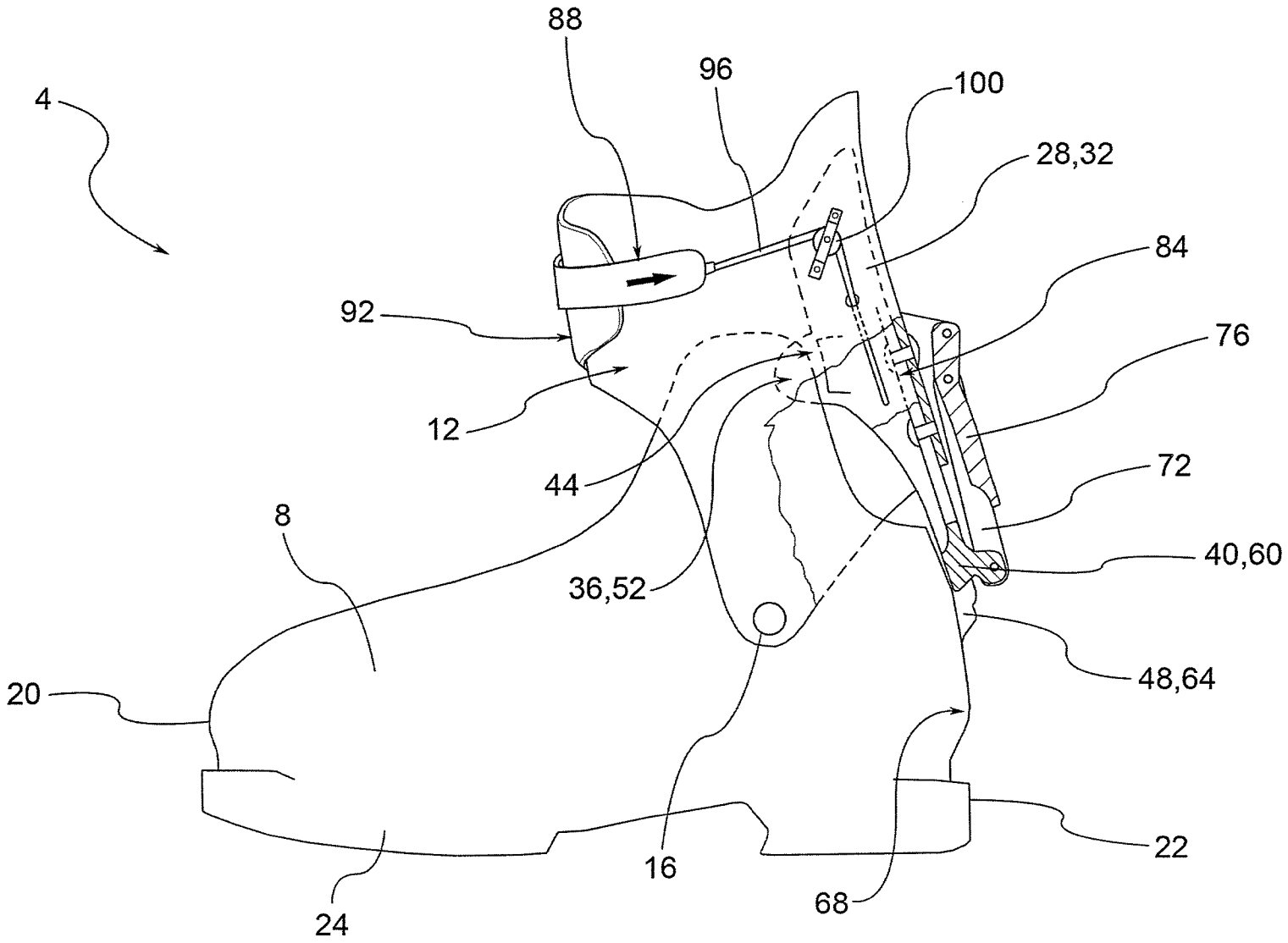
FIG. 6 shows a lateral section view of the ski boot of FIG. 5, in a ski configuration, wherein the cuff is blocked in rotation.

With reference to above listed figures, with reference numeral 4 it is indicated a ski boot comprising a lower part or shell 8, suitable for enclosing the user's foot and an upper part or cuff 12, suitable for enclosing the lower part of the skier's leg. Please note that the definition of ski boot should be considered in a general manner and not restrictive: therefore with the term 'ski boot' it is indicated a mountaineering ski boot, an Alpine ski boot or also a Telemark ski boot. Therefore the scope of protection of the present invention is not limited to the specific type of ski boot.

Moreover, please note that the definitions of the shell and of the cuff should be considered in a general manner and not restrictive: the present invention does not present any type of limitation in respect of shapes, sizes, materials, type of cuff and shell, and therefore fall in the invention also types of cuff and shell which at least partially embrace the foot and the lower part of the leg, namely the shank of the skier. The cuff 12 is hinged to the shell 8 so as to rotate relative to the shell 8 around hinges 16 defining a rotation axis X-X, forward, toward a tip 20 of the boot 4, and backwards toward a heel 22 of the boot 4.

The type of hinge 16 can be varied and, preferably, there is provided a pair of hinges 16 arranged on opposite sides with respect to the cuff 12.

Preferably, the hinges 16 identify an axis of rotation X-X horizontal, i.e. parallel to a sole 24 of the boot 4.

The boot 4 comprises fastening means 28 suitable for selectively locking and/or unlocking the rotation of the cuff 12 with respect to the shell 8 depending on whether the user wants to switch from a skiing configuration to a walking configuration, respectively. Advantageously the fastening means 28 comprise a slider interposed between the cuff 12 and the shell 8, wherein said slider 32 is fixed in rotation to the cuff 12 and it comprises first and second end stops 36,40, placed at opposite sides of the slider 32.

The slider 32 is movable with respect to the cuff 12 in order to move from the unlock or walking configuration, wherein the first and second end stops 36,40 do not interfere with the rotation of the cuff 12 with respect to the shell 8, to the lock or ski configuration, wherein the first and second end stops 36,40 are configured so that, at the same time, abut against respective first and second abutment 44,48 of the shell 8.

According to possible embodiments, the slider 32 is movable in translation and/or in rotation with respect to the cuff 12.

In particular, first abutment 44 blocks the forward rotation of the cuff 12 with respect to the shell 8 and second abutment 48 blocks the backward rotation of the cuff 12 with respect to the shell 8.

The slider 32 is configured so that, in said blocking configuration, it is compressed between said first and second abutment 44,48 of the shell 8, in order to avoid any clearance (play, movement) in rotation between the cuff 12 and the shell 8.

According to an embodiment, the first end stop 36 of the slider 32 comprise a couple of lugs 52 which are at least partially countershaped with respect to a correspondent edge 56 of the shell 8. The lugs 52 act as first end stops 36 of the slider 32.

According to a possible embodiment, the second end stop 40 of the slider 32 comprises a tooth 60 which is at least partially countershaped with respect to a correspondent boss 64 of the shell 8. The boss 64 acts as second abutment 48 of the shell 8.

Preferably the slider 32 is countershaped with respect to a bottom portion 68 of the shell 8, in order to partially wrap said bottom portion 68.

For example, the slider 32 is connected with a leverage 72 to the cuff 12 in order to urge the slider 32 from the ski to the walking configuration and vice versa, said linkage 72 being positioned, preferably, in a rear part of the cuff 12, facing the heel 22 of the ski boot 4 and having a gripping portion 76 for a user.

According to an embodiment, the slider 32 and the cuff 12 have corresponding shapes or, in other words, are at least partially countershaped. In this way, there is a larger contact zone/surface area for the transfer of load and preload between matching components of the boot.

Preferably, the slider 32 is connected to the cuff 12 by means of a prismatic coupling.

According to an embodiment said prismatic coupling comprises a slot 80 and a coupling element 84 that engages in the slot 80. For example the coupling element 84 comprises a fastening component and/or linear guide that engages in the slot 80.

Said coupling element 84 may be a fastening component, which secures the slider 32 to the inside of the cuff, and/or a linear guide which enables the slider 32 to track correctly, guiding it through its range of travel.

According to an embodiment, the cuff 12 comprises closure means 88 for opposite flaps 92 of the cuff 12, wherein said closure means 88 are operatively connected to the movement of the slider 32 so as to tighten the closure means 88 in the configuration of skiing and to open or loosen the flaps 92 of the shell 8 in the configuration for walking.

For example said closure means 88 are operatively connected to the slider 32 by means of cables and/or mechanical linkage 100.

Thanks to the connection between the closure means 88 and the slider 32 it is possible, in a unique movement, both closing the closure means and blocking the rotation of the cuff 12 (in the so called ski configuration) and opening the closure means and allowing the rotation of the cuff (in the so called walking configuration).

The "Knee joint" design of the leverage 72 in combination with the slider 32 and with the end stops 36,40 provides ultimate leverage/mechanical advantage to close the system: tensioning the closure means 88 (upper buckles and power strap) while simultaneously applying preload to the locking ski mode system. There is also almost no loss of applied tension when closing the system because of the minimal travel of the pivot points of the leverage and linkage beyond the "dead point" of the three corresponding pivots of the closure system: the user retains almost all of the force required to close the system within the closure means/buckle and power strap tension.

As can be appreciated from the description, the mountaineering ski boot according to the invention allows to overcome the drawbacks presented in the prior art.

In particular, in the configuration of opening or unlocking, the rotation of the cuff with respect to the shell does not encounter any resistance noticeable by the user, since the cuff does not encounter obstacles to rotation, in either direction of cuff rotation.

Also the locking of the cuff with respect to the shell is extremely rigid and does not provide for any clearance that can also allow small movements of the cuff with respect to the shell.

In fact, the solution of the present invention includes the presence of two constraints unilateral, distinct and opposite each other, so as to stop, each, a direction of rotation of the cuff with respect to the shell.

The two constraints (end stops 36/40) are formed on opposite sides of the same slider, which is integral in rotation with the cuff and sliding in translation with respect to the latter, in the passage from the configuration of walking to that of skiing.

In fact the slider 32 forces the cuff to rotate forward against the end stops 36 on the shell 8 that represent the end of the forward stroke to the rotation of the cuff.

Furthermore, the same slider represents a block or limit the rearward rotation of the cuff with respect to the shell (interface/contact between 40,60 and 48,64).

As seen, in the closed or ski configuration the slider is in a state of compression so as to prevent any type of clearance or movement that can reduce the feeling of stiffness and precision from the user.

In particular, the present solution applies a preloaded connection on the components of the ski boot to provide even more rigidity in the interface between the cuff and shell, creating a progressive forward flex of the ski boot. This is achieved by compressing interacting/interlocking surfaces (end stops) the system presses itself together before any forward flex in introduced thus when the boot is flexed forward. The boot responds with a "progressive flex" because of immediate contact. Of course this preloaded design also compensates for clearance (play) between the components of this system (for instance tolerance's in the manufacturing process).

In this way there is no possibility of clearance or slack of the cuff, since any rotation/movement of the leg portion is prevented by the locking means.

This architecture gives a high rigidity to the structure of the boot entirely comparable with respect to that of the corresponding Alpine/ski boot with a fixed cuff. Therefore the skier, in the closed or locking configuration, has the feeling of using a ski boot since he feels high rigidity and precision; also the skier does not receive any feeling of clearance or slack and not hear any noise due to contact between parts coupled together, as is the case in the solutions of the known art.

Furthermore, the boot according to the present invention is extremely easy to use since the locking/unlocking is done with a simple movement of the actuating lever 76.

The mechanism for locking and unlocking 72,76 is extremely reliable and easy to use: it can be easily and repeatedly operated by the user even when wearing gloves.

Moreover, thanks to the solution of the present invention, there are no constraints for the positioning of the hinges 16 of the cuff 12 with respect to the shell 8: in this way the designer has more freedom of design.

Furthermore, the locking mechanism is displaced in a position protected by accidental impacts as it is located in the upper part of the boot, well above the hinges 16.

One skilled in the art, in order to satisfy contingent and specific needs, may make numerous modifications and variations to the boots described above, all however contained within the scope of the invention as defined by the following claims.

The invention claimed is:

1. A ski boot apparatus, comprising:

a lower shell suitable for enclosing the user's foot and an upper cuff suitable for enclosing the lower part of the user's leg, the shell including first and second abutments on the shell, wherein the first abutment is positioned inside the boot and the second abutment is positioned outside the boot, wherein the cuff is hinged to the shell so as to rotate relative to the shell around hinges defining a rotation axis, the cuff being rotatable relative to the shell forward toward a tip of the boot and backwards toward a heel of the boot, wherein the boot comprises a slider suitable for selectively locking and unlocking the rotation of the cuff with respect to the shell depending on whether the user wants to switch from a skiing configuration to a walking configuration, respectively, wherein the slider is disposed inside the cuff interposed between the cuff and the shell, wherein said slider is fixed in rotation to the cuff, and the slider comprises first and second end stops placed at opposite sides of the slider, wherein the slider is movable in translation with respect to the cuff in order to move between the walking configuration and the skiing configuration, wherein the first and second end stops on the slider do not interfere with the rotation of the cuff with respect to the shell when the slider is in the walking configuration, wherein the second end stop on the slider disengages from the second abutment when the slider is in the walking configuration, wherein the first and second end stops on the slider are configured so that when the slider is in the skiing configuration the first end stop abuts the first abutment on the shell inside the boot and the second end stop also protrudes from the cuff and abuts the second abutment on the shell outside the boot at the same time, and wherein the first abutment blocks the forward rotation of the cuff with respect to the shell and the second abutment blocks the backward rotation of the cuff with respect to the shell when the slider is in the skiing configuration.

2. Ski boot according to claim 1, wherein the slider is configured so that, when the slider is in the skiing configuration, it is compressed between said first and second abutments of the shell, in order to avoid any clearance in rotation between the cuff and the shell.

3. Ski boot according to claim 1, wherein the first end stop of the slider comprises first and second lugs on the slider inside the boot which are at least partially countershaped with respect to a correspondent edge of the shell.

4. Ski boot according to claim 1, wherein the second end stop of the slider comprises a tooth which is at least partially countershaped with respect to a correspondent second abutment of the shell outside the boot.

5. Ski boot according to claim 1, wherein the slider is countershaped with respect to a bottom portion of the shell, in order to partially wrap said bottom portion.

6. Ski boot according to claim 1, wherein the slider and the cuff have corresponding shapes so as to have a larger contact zone for the transfer of load and preload between matching components of the boot.

7. Ski boot according to claim 1, wherein the slider is connected to the cuff by a prismatic coupling.

8. Ski boot according to claim 7, wherein said prismatic coupling comprises a slot and a coupling element that engages in the slot.

9. Ski boot according to claim 8, wherein the coupling element comprises a fastening component which secures the slider to the inside of the cuff and a linear guide which enables the slider to track correctly, guiding it through its range of travel.

* * * * *